US005397028A

United States Patent [19]

Jesadanont

[11] Patent Number: 5,397,028

[45] Date of Patent: Mar. 14, 1995

[54] AUTOMATIC FLUID DISPENSER AND METHOD

[76] Inventor: Mongkol Jesadanont, 386/2 Soi Chalermsuk (Pahonyothin 28), Jatujak, Bangkok 10900, Thailand

[21] Appl. No.: 305,407

[22] Filed: Sep. 13, 1994

Related U.S. Application Data

[63] Continuation of Ser. No. 29,758, Mar. 11, 1993, abandoned, which is a continuation-in-part of Ser. No. 875,789, Apr. 29, 1992, abandoned.

[51] Int. Cl.[6] ..... B67D 5/08; B67D 5/64

[52] U.S. Cl. ..... 222/1; 222/36; 222/52; 222/162; 222/181; 222/183; 222/402.1; 222/504; 222/568

[58] Field of Search ..... 222/1, 36, 38, 39, 52, 222/63, 160, 162, 180, 181, 183, 394, 402.1, 505, 568

[56] References Cited

U.S. PATENT DOCUMENTS

| | | | |
|---|---|---|---|
| 2,914,222 | 11/1959 | Meshberg . | |
| 3,127,060 | 3/1931 | Vosbikian et al. . | |
| 3,191,809 | 6/1965 | Schultz et al. | 222/402.1 |
| 3,195,777 | 7/1965 | Hart . | |
| 3,216,618 | 11/1965 | Hunter . | |
| 3,272,392 | 9/1966 | Meshberg | 222/162 |
| 3,273,752 | 9/1966 | Horeczky . | |
| 3,420,445 | 1/1969 | Inzerill . | |
| 3,455,485 | 7/1969 | Crownover . | |
| 3,517,667 | 6/1970 | Babbin et al. | 222/162 X |
| 3,575,640 | 4/1971 | Ishikawa . | |
| 3,650,435 | 3/1972 | Kleefeld . | |
| 3,952,916 | 4/1976 | Phillips . | |
| 4,238,055 | 12/1980 | Staar . | |
| 4,326,648 | 4/1982 | Kieber . | |
| 4,512,587 | 4/1985 | Burke et al. | 277/205 |
| 4,552,163 | 11/1985 | Biancalana et al. . | |
| 4,645,094 | 2/1987 | Acklin et al. | 222/52 |
| 4,670,010 | 6/1987 | Dragone | 604/289 |
| 4,688,585 | 8/1987 | Vetter . | |
| 4,722,372 | 2/1988 | Hoffman et al. | 141/98 |
| 4,817,651 | 4/1989 | Crisp et al. . | |
| 4,817,822 | 4/1989 | Rand et al. | 222/162 X |
| 4,338,456 | 6/1989 | Hamlin . | |
| 4,921,150 | 5/1990 | Lagergren et al. | 222/639 |
| 4,925,495 | 5/1990 | Crisp et al. . | |
| 4,946,070 | 8/1990 | Albert et al. | 222/52 |
| 4,967,935 | 11/1990 | Celeste | 222/63 |
| 5,024,355 | 6/1991 | Jouillat et al. | 222/162 |
| 5,059,187 | 10/1991 | Sperry et al. . | |
| 5,060,323 | 10/1991 | Shaw . | |
| 5,062,164 | 11/1991 | Lee et al. . | |
| 5,074,520 | 12/1991 | Lee et al. . | |
| 5,082,149 | 1/1992 | Cross | 222/162 |
| 5,095,941 | 3/1992 | Betz . | |
| 5,105,992 | 4/1992 | Fender et al. | 222/185 |
| 5,170,514 | 12/1992 | Weigert . | |
| 5,199,118 | 4/1993 | Cole et al. . | |
| 5,224,509 | 7/1993 | Tanaka et al. . | |

FOREIGN PATENT DOCUMENTS

| | | |
|---|---|---|
| 0162206 | 11/1985 | European Pat. Off. . |
| 2515491 | 10/1976 | Germany . |

*Primary Examiner*—Kevin P. Shaver
*Attorney, Agent, or Firm*—Poms, Smith, Lande & Rose

[57] ABSTRACT

An automatic dispenser for spraying a liquid or flowable disinfectant to dermatologically treat hands or the like. The dispenser automatically senses the presence of a user's hands using an infrared sensing mechanism, and in response sprays a predetermined volume of volatile disinfectant onto the user's hands for a predetermined length of time via a control circuit. The control circuit supplies an electromagnet with power for the predetermined length of time to move a magnetic frame downward against an inverted bottle of disinfectant in the dispenser housing. The bottle contains a known quantity of disinfectant fluid and the dispensing operation dispenses a measured dose upon each actuation. A counter circuit then counts the doses dispensed and provides a warning signal when the bottle is empty or nearly empty of the flowable disinfectant. The dispenser has a nozzle with a conically shaped outlet which is in fluid communication with the inside of the bottle via a short tube which extends from the bottle opening and fits tightly to the nozzle. The dispenser operates automatically and avoids the need for the user to physically touch it. The user's hands thereby can be completely disinfected without the risk of recontamination from contact with the dispenser or with hand driers since the disinfectant is volatile and quickly evaporates.

39 Claims, 5 Drawing Sheets

AUTOMATIC FLUID DISPENSER AND METHOD

CROSS-REFERENCE TO RELATED APPLICATION

This is a continuation of application Ser. No. 08/029,758, filed Mar. 11, 1993, now abandoned, which is a continuation-in-part of application Ser. No. 07/875,789, filed Apr. 29, 1992, now abandoned whose entire contents are hereby incorporated by reference.

BACKGROUND OF THE INVENTION

The present invention relates to a fluid spraying device for the dermatological treatment of hands, and more particularly to a disinfectant dispenser, and to the construction and operation thereof.

In the past, dispensers have been used to dispense powdered or atomized liquids for use on different parts of the human body, such as the face or limbs. Most previous dispensers for dispensing various liquids for medical or disinfectant purposes have been designed such that the user must physically contact the dispenser. For hygienic reasons, this presents a problem since the dispenser can become contaminated and aid in the spread of diseases to the users thereof. Prior devices have only been of moderate success, even those specifically designed for medical or commercial applications. Many disadvantages have been experienced with such devices, such as clogging thereof, a structure which is complicated to build, maintain and service, and the requirement that the dispenser it must be contacted to be used. Moreover, most previous automatic devices also suffer from complicated mechanisms, unreliable warning systems for indicating that the container or reservoir is empty and inefficient dispensing of the fluids.

An effective method of applying a liquid or flowable disinfectant is by spraying it. This ensures the penetration of the fluid droplets into the skin. Spraying also optimizes hygienic conditions because no build-up or deposits of the disinfectant are produced on the dispenser. Thus, devices required for collecting and cleaning leftover particles or droplets are unnecessary. Spraying also eliminates the need for hand driers, which are easily and often contaminated. When volatile disinfectants are used, all that is required is that the user's hands be rubbed together to properly spread the disinfectant and irrigate the palms and the backs of the hands. Both hands can thereby be completely disinfected without contacting any surfaces. With many prior devices, the above-mentioned problems are caused by the fact that the disinfectants are often just sprinkled onto the hands and not sprayed thereon. Irrigation of the hands of the user is more likely to be concentrated on the backs of the hands instead of the palms which require the most irrigation.

Another disadvantage of some prior devices is that they have significant operating inertia. A significant time interval is required before the next dispensing cycle can begin. These shortcomings impose limitations on the practical use of these devices in hospitals and other places where they must be used continuously by a large number of people. Moreover, the prior devices are relatively complex, expensive and bulky, and many require a built-in battery pack. Accordingly, these devices are unsuitable for a wide variety of uses, especially where hygiene is critical.

FIG. 1 illustrates the general operation of a conventional spray bottle 15 A pressurized gas is contained in the bottle 15 along with the material to be sprayed. A piece of soft plastic tubing 16 is disposed along substantially the entire height of the bottle 15. The tubing 16 carries the material, such as liquid L, from the bottle 15 to outlet tubing 17 and then through push button 18. Application of a force F on push button 18 causes a valve (not shown) to open, whereby the pressurized gas in the bottle 15 forces liquid L upward through tubes 16, 17 and out through a nozzle on the push button as spray S. This conventional bottle 15 dispenses liquid L primarily from the bottom of the bottle upward through the tubes 16, 17, and relies on the pressurized gas to force the liquid L in a direction opposite the natural gravitational pull. Another disadvantage of many conventional bottles is that the liquid cannot be completely dispensed from them. Because the bottles 15 are used in an upright position and the end of the tubing 16 which is disposed inside the bottle 15 cannot reach all of the liquid, some liquid is not used and thus is wasted. Yet another problem is that the user must touch the bottle 15 to spray the liquid L, and in sterile environments where the liquid used is a disinfectant, contact with the bottle can contaminate the user's hands.

The following patents exemplify known automatic fluid dispensers. These patents and any other patents or publications mentioned anywhere in this disclosure are hereby incorporated by reference in their entireties, U.S. Pat. No. 4,946,070 to Albert et al. discloses a surgical soap dispenser which dispenses soap from a flexible pouch. The pouch is contained in a housing and has an elongated dispensing leg which extends through a pumping mechanism. When the user's hands are detected in a triggering field by a light emitting diode (LED) and a light sensor, a DC motor is actuated to drive a gearing system coupled to a shaft on which the pumping mechanism is rotatably mounted. The pumping mechanism includes a roller which moves against the dispensing leg along a base pad and causes the soap in the dispensing leg to be dispensed through a pressure responsive valve. The path of the roller is configured to dispense one metered dose of soap per actuation of the motor.

U.S. Pat. No. 4,722,372 to Hoffman et al. discloses an electrically operated dispensing device in which a disposable container of flowable material includes a deformable extension for containing a predetermined quantity of material. The container is retained in a housing which has a dispensing mechanism through which the extension is placed. The dispensing mechanism is actuated by a photocell system which detects the proximity of the user's hands or other object to be cleaned. The mechanism moves a lever arm to pinch the deformable extension and dispense the material through a check valve when the pressure in the extension is sufficiently high.

U.S. Pat. No. 4,670,010 to Dragone discloses a liquid-nebulizing device for spraying a disinfectant on the hands of the user. The device includes a liquid reservoir and a dispensing mechanism. The dispensing mechanism includes a spray nozzle and pumping unit which delivers liquid to the nozzle. A system of conduits connects the reservoir and pumping unit in series, and the pumping unit to the spray nozzle. A solenoid valve of the pumping unit allows liquid to freely flow to the reservoir when the valve is open, but keeps the liquid in the delivery conduit when the valve is closed. A sensor detects the presence of hands in the upper cavity, starts the pump and closes the solenoid valve. Upon activation of the pump, the liquid in the delivery conduit is forced out through the nozzle in a spray. A warning system senses the amount of liquid in the reservoir and signals a user to refill it.

U.S. Pat. No. 4,645,094 to Acklin et at. discloses a photo-electric controlled dispenser housing a flexible container with a dispensing extension. The housing is equipped with a pinch valve and a means to squeeze the container. An infrared proximity sensor actuates the mechanism, and the dispensing time period is regulated by controlling the time that the valve remains open. A warning system senses the amount of liquid in the container by the angle of the squeezing means.

U.S. Pat. No. 3,650,435 to Kleefeld discloses an SCR circuit for use with a photoelectric controlled dispenser. The circuit supplies current to a pump to dispense the liquid. The pump is turned off by interrupting the SCR current by mechanical means or a timing switch.

U.S. Pat. No. 3,273,752 to Horeczky discloses a photo-electric controlled dispenser which dispenses flowable material that is not pressurized. The dispenser has a housing which retains a container in an upside down orientation with the outlet thereof pointed downward. The container has a magnetic pellet inside the neck which normally closes off the opening of the container. A photocell detects the presence of the user's hands and triggers a timer circuit. The timer circuit in turn energizes an electromagnet in the housing which is adjacent the neck of the container. When the electromagnet is energized the pellet in the container is pulled from its resting position toward the wall of the container adjacent the electromagnet thereby enabling flowable material to be dispensed. The timing circuit controls the length of time the pellet is held by the electromagnet. Only a fixed amount or dose is dispensed with each dispensing cycle.

Accordingly, there exists a need for an automatic dispenser for dispensing fluids in measured doses which does not require a user to contact the dispenser or any other equipment such as a drier. In particular, a simply constructed, reliable dispenser is needed for sterile environments to dispense volatile disinfectants with a fine spray action.

SUMMARY OF THE INVENTION

The objects and advantages of this invention are achieved by a fully automated spraying device for dispensing flowable materials, and particularly a volatile disinfectant to dermatologically treat the user's hands. Examples of other flowable materials which may be dispensed are liquid soaps, lotions, liquid-solid slurries and fluidized powders, but the invention is particularly suited for dispensing sprayable materials. A technical problem to be solved by this invention is to provide a fully automated dispenser that sprays fluids to quickly and efficiently irrigate both hands of the user. The present fully automated dispenser includes a housing having two chambers. One chamber contains two power sources, a control circuit, a counter circuit and a solid state relay. The other chamber contains a spray bottle filled with disinfectant and a pressurized gas, an electromagnet, a magnetic frame and an infrared light sensor which is located at the bottom of the dispenser. The spray bottle is installed upside-down with the magnetic frame on top of the bottle.

A power source connected to a first power converter continuously supplies power to the infrared sensor, the control circuit, the solid state relay and a counter circuit. Upon introduction of the user's hands underneath the dispenser, the infrared sensor senses the presence of the hands and activates the control circuit. The control circuit in turn actuates the solid state relay for a predetermined length of time so that the switch in the relay remains closed for the reset delay. During the time the switch in the relay is closed, a second power source connected to a second power converter energizes the electromagnet to magnetically draw the magnetic frame downward and thereby press down on the spray bottle. A spray nozzle operatively connected to the bottle dispenses volatile fluid disinfectant onto the hands of the user with this pressing down motion. The volume of disinfectant dispensed is a function of the length of time the bottle is depressed. Therefore, the timing unit in the control circuit can be set to provide dispensing action to dispense an optimal amount of disinfectant. Moreover, the time interval between successive dispensing cycles is negligible, such that continuous use of the dispenser is possible.

The control circuit actuates the counter circuit simultaneously with the actuation of the solid state relay. The counter circuit is initially set to a predetermined value and counts down each time it is actuated. As the counter approaches zero, this indicates that the spray bottle will be nearly empty, because each spray bottle of this invention contains exactly the same volume of fluid and an exact amount of pressurized gas. A timing unit in the control circuit is preset to provide the downward push on the frame for a predetermined time thus ensuring that a predetermined volume of fluid is dispensed each time. The total number of pushes needed for emptying the spray bottle can be experimentally determined. When the value in the counter circuit is zero (or close to zero), the counter circuit actuates a buzzer (or light or other signal) to notify the user or attendant. The buzzer can be continuously sounded until a new spray bottle is installed and the counter circuit reset. On no parts of the dispenser is disinfectant deposited which would necessitate cleaning thereof.

The spray nozzle of this invention is generally conical in shape having an upper portion and a lower portion. The upper portion is cylindrical and has internal threads which mate with outside threads of a preferably hard plastic tubing extending outwardly from the spray bottle opening. The threaded connection between the nozzle and the tubing prevents leakage. The lower portion of the nozzle is a conically shaped opening or hole wherein the upper diameter of the conical opening is equal to the diameter of the upper portion of the nozzle, that is, the diameter of the cylindrical portion. The diameter of the bottom of the conical opening, which is the outlet of the nozzle, is substantially smaller than the upper diameter of the opening. This enables the fluid to be sprayed in fine droplets and therefore over a wide area. The volatile fluid is atomized and sprayed evenly on the hands to be irrigated to ensure efficient dermatological treatment thereof. A hand drier is thus unnecessary with the present invention because once the sprayed volatile fluid irrigates the hands it quickly evaporates.

These and other features and advantages of the invention may be more completely understood from the following detailed description of the preferred embodiments of the invention with reference to the accompanying drawings.

DETAILED DESCRIPTION OF PREFERRED EMBODIMENTS

Figure 2:
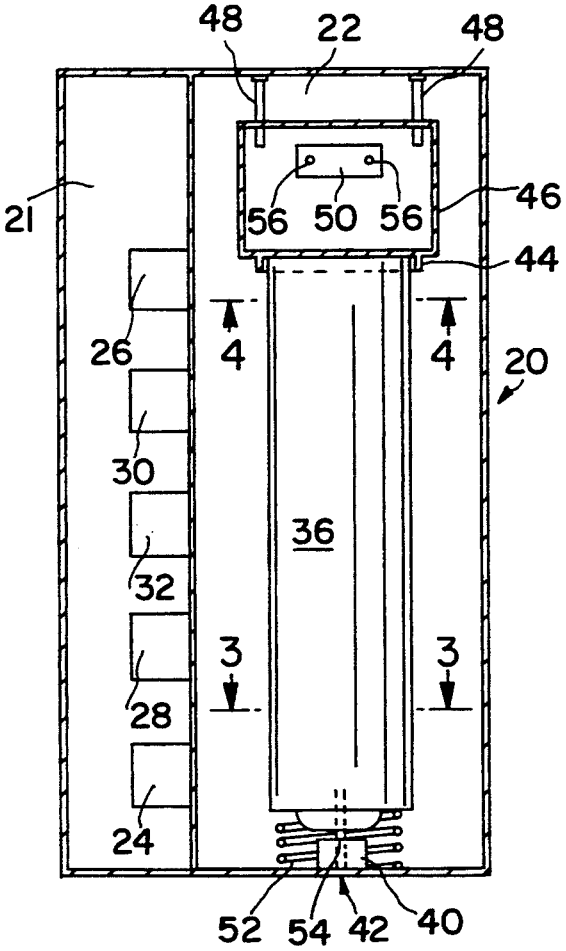
FIG. 2 is a front sectional view of a dispenser constructed according to the present invention.
Figure 3:
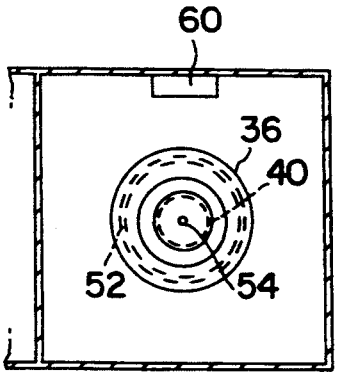
FIG. 3 is a cross-section of a portion of the dispenser taken along line 3—3 of FIG. 2 showing the position of the infrared light sensor thereof.
Figure 4:
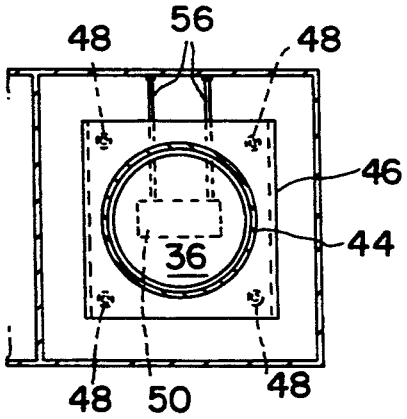
FIG. 4 is a cross-section of a portion of the dispenser taken along line 4—4 of FIG, 2.
Figure 10:
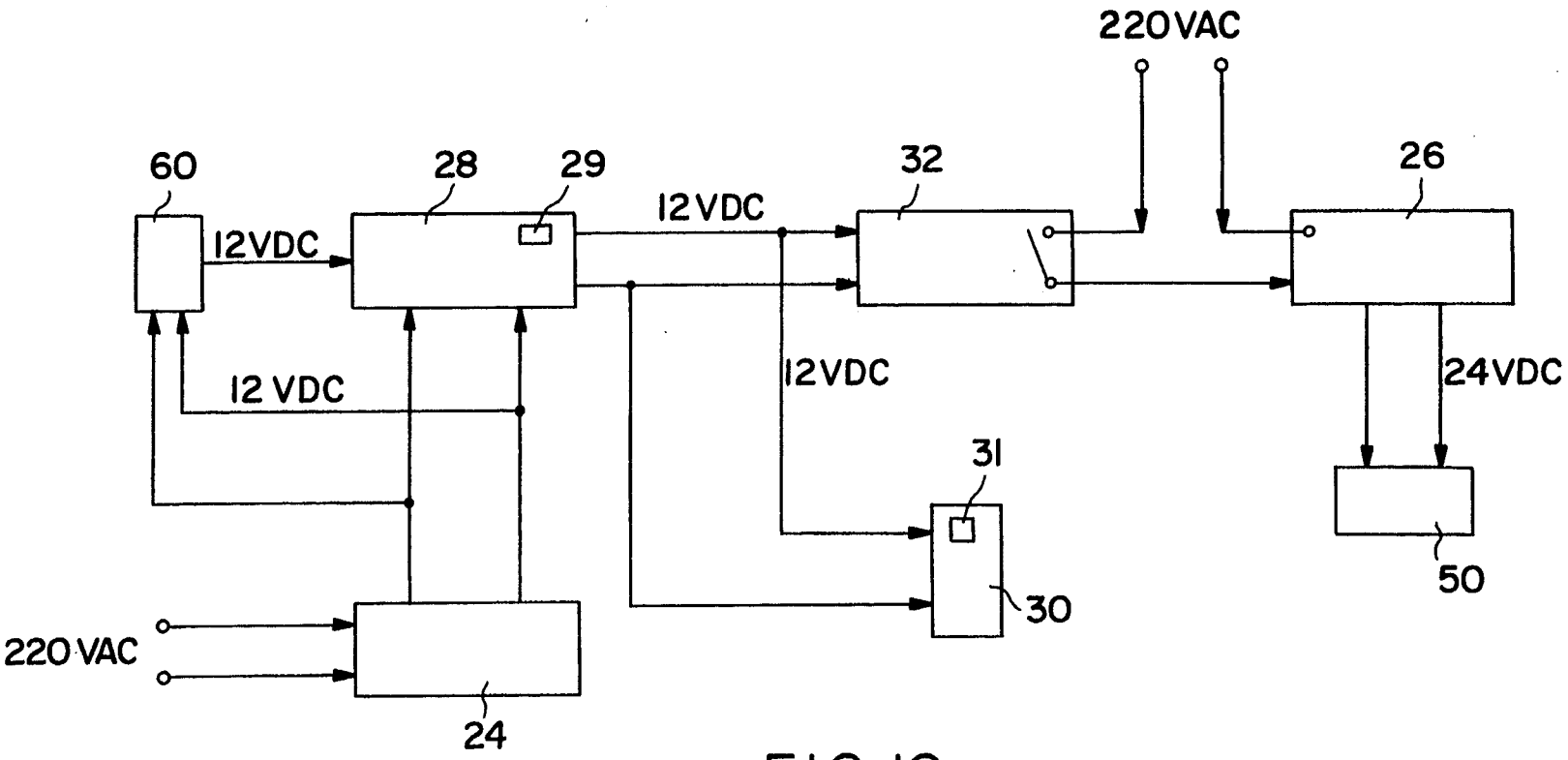
FIG. 10 is a schematic circuit diagram of the dispenser of FIG. 2.

With reference to the drawings wherein like numerals indicate like elements, FIG. 2 discloses a dispenser shown generally at 20 according to the present invention. Dispenser 20 comprises a housing having chambers 21 and 22. In chamber 21, two power sources 24 and 26, a control circuit 28, a counter circuit 30, and a solid state relay 32 are installed. A simplified circuit diagram is shown in FIG. 10. In chamber 22, spray bottle 36 is placed inverted with spray nozzle or outlet 40 adjacent the bottom opening 42 of the dispenser 20. Spray bottle 36 is retained in a vertical position by cap 44, which is fixed to reciprocating magnetic frame 46. Frame 46 has four holes, one at each comer thereof. Corresponding rods or pins 48 are attached to and extend from dispenser 20. The rods 48 are movably positioned in the holes so that frame 46 can move freely in a vertical direction guided by rods 48. The bottom of frame 46 rests on the bottom of spray bottle 36. While the maximum gap between the top part of frame 46 and the top part of electromagnet 50 is preferably three millimeters, the gap between the bottom part of electromagnet 50 and the bottom part of frame 46 is preferably not less than six centimeters. The frame 46 is made of a magnetic material such as steel which is attracted by a magnetic force. Spring 52, located at the bottom of chamber 22, also helps maintain the spray bottle 36 and spray nozzle 40 in place by biasing the spray bottle against frame 46. A relatively short piece of plastic tubing 54 provides fluid communication between the inside of spray bottle 36 and spray nozzle 40. As shown in FIG. 4, electromagnet 50 is fixed in dispenser 20 near the top thereof by rods 56, which may or may not be of a magnetic material. A proximity sensor 60 is preferably positioned adjacent the bottom of dispenser 20 and is preferably located toward the back of the dispenser 20 as shown in FIG. 3. The proximity sensor 60 can be any known sensing mechanism, as discussed in detail later, and preferably is an infrared sensor.

Figure 1:
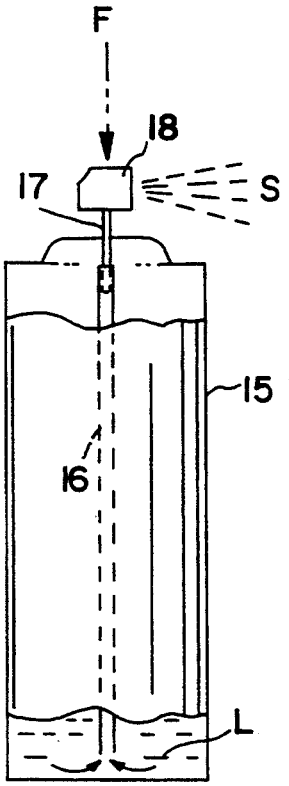
FIG.1 PRIOR ART
FIG. 1 is a sectional view of a conventional spray bottle.

A dispenser made in accordance with the present invention advantageously does not require a soft plastic tubing, such as tubing 16 used in the conventional design shown in FIG. 1. Thus, the structure of the dispenser 20 is simplified. Moreover, the dispenser 20 positions the bottle 36 in an inverted manner, and thereby utilizes gravity to ensure that all of the liquid in the bottle is dispensed. All that is required to carry the liquid to the nozzle 40 is a short piece of tubing 54.

Figure 5:
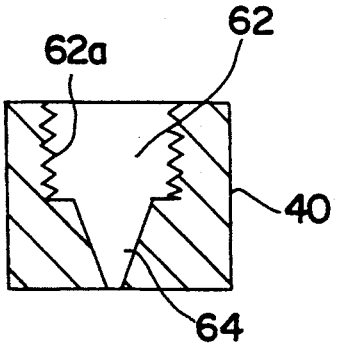
FIG. 5 is a longitudinal cross-sectional view of a spray nozzle of the dispenser of FIG. 2 with internal threads and a cone shaped outlet.
Figure 6:
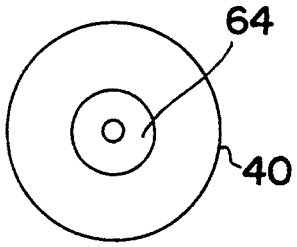
FIG. 6 is an end view of the spray nozzle shown in FIG. 5.
Figure 7:
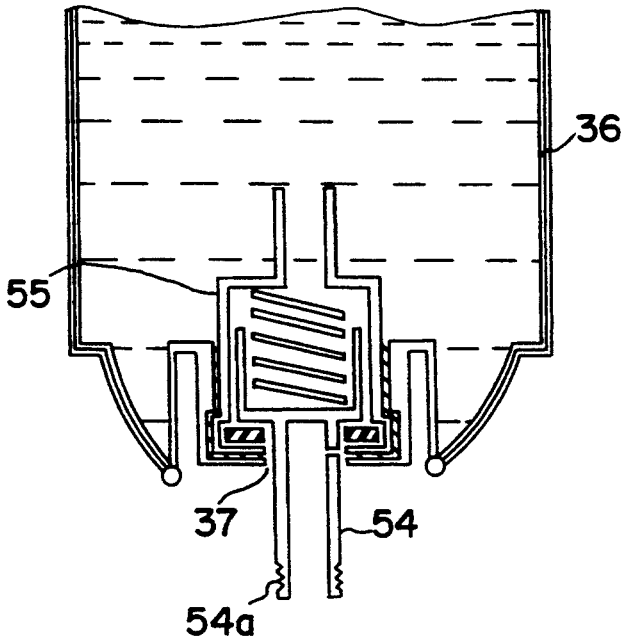
FIG. 7 is a longitudinal cross-sectional view of the externally threaded end of the plastic tubing extending outwardly from the spray bottle and with the valve of FIG, 2 schematically illustrated.
Figure 8B:
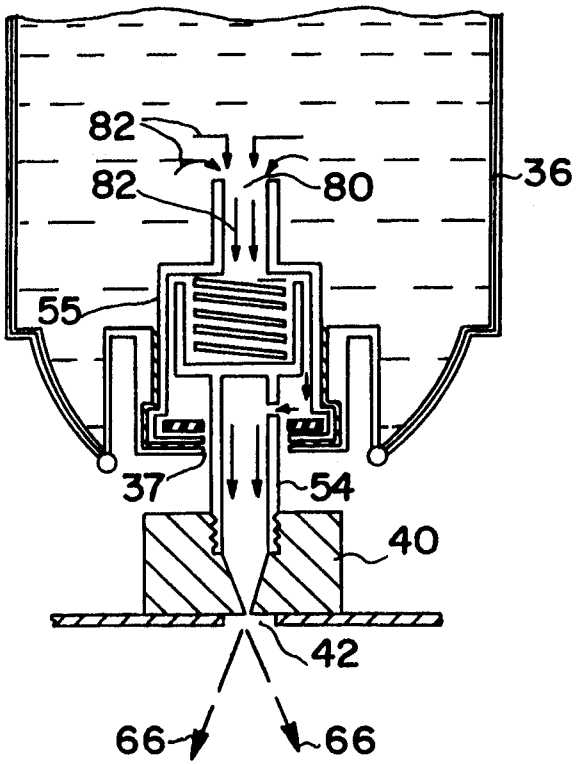
FIG. 8B is a view of the nozzle and valve assembly of FIG. 8A during a dispensing operation.
Figure 8A:
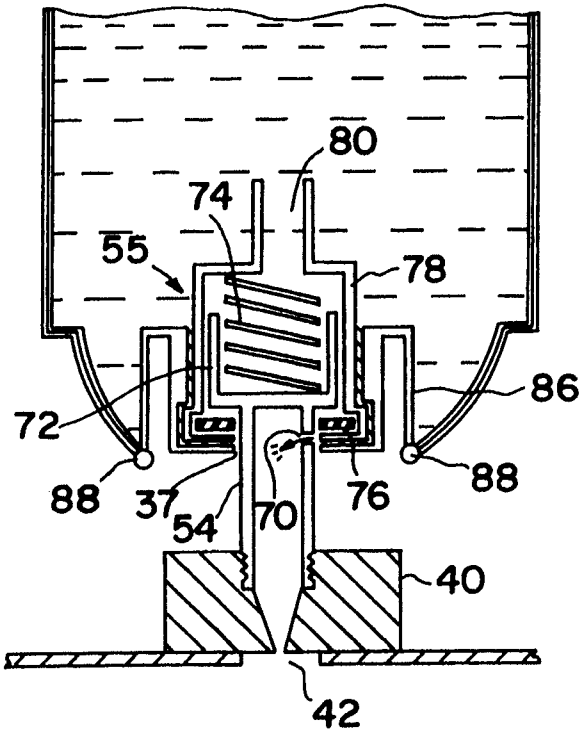
FIG. 8A is a longitudinal cross-sectional view of the plastic tubing and valve of FIG. 7 shown threaded tightly into the upper portion of the spray nozzle.

Referring to FIGS. 7, 8A and 8B, the tubing 54 is preferably rigid, acts as a connector between the bottle opening 37 and the nozzle 40, and is tightly fitted to the nozzle 40. A normally closed valve 55 is provided in tubing 54 inside the bottle 36. When the spray bottle 36 is depressed by the downward movement of the magnetic frame 46, the bottle opening 37 moves downward along the tubing 54 thereby opening the normally closed valve 55 to allow the liquid to be dispensed from the bottle through the conically shaped hole 64 of nozzle 40. Tubing 54 has an externally threaded end **54*a*, as shown in FIG. 7, to mate with the internal threads 62*a* of opening 62 in the upper portion of spray nozzle 40 shown in FIG. 5. Lower opening 64 in the lower portion of the spray nozzle 40 has a conical shape. The top of the lower opening 64 is of substantially the same diameter as the inner diameter of the tubing 54. The lower opening 64 tapers so that the bottom thereof has a diameter that is substantially smaller than the diameter at the top thereof. The taper of the conical shape is gradual to provide a venturi effect; that is, the velocity of fluid through the cone of the spray nozzle 40 increases as it nears the opening an outlet. In addition, fluid flowing along the tapered wall of the cone-shaped opening 64 spreads over a broader area at the outlet than liquid through a cylindrical hole would. The direction of the fluid movement through the cone-shaped lower opening is shown by arrows 66 in FIG. 8B**.

Figure 9:
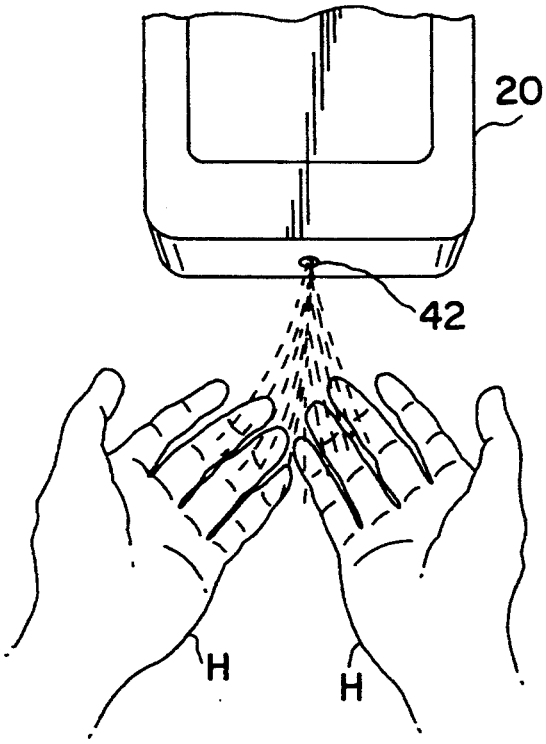
FIG. 9 shows disinfectant being sprayed onto hands held in position under the dispenser of FIG. 2.

As a result, fluid is sprayed out of dispenser 20 in fine droplets and over a broad area, as shown in FIG. 9 for example. Any leakage of fluid in an upward direction might result in leftover disinfectant in the dispenser 20; this could necessitate undesirable cleaning of the fluid chamber. Such a problem is solved by this invention by the threaded connection of the tubing 54 to spray nozzle 40 as shown in FIG. 8. Although the preferred connection is by mating threads, any non-permanent leak-proof connection, including a snap-fit connection, is within the scope of the invention.

FIGS. 8A and 8B schematically illustrate the valve 55 in the upper part of tubing 54. The valve 55 is a conventional normally closed valve widely used with spray bottles, and generally comprises a valve hole 70 in the wall of the tubing 54. The upper end of tubing 54 includes a relatively small plastic cylindrical cup 72 containing a spring 74. A rubber ring 76 fits tightly around tubing 54, is positioned directly beneath cup 72 and is held within a socket of plastic valve housing 78. The upper part of valve housing 78 is configured as a hollow tube 80 where fluid in the spray bottle 36 can flow as indicated by arrows 82. The lower part of the valve housing 78 forms an annular ridge extended and tightly fitted into the socket of a metal valve housing 86. The walls of plastic valve housing 78 and metal valve housing 86 are directly adjacent one another with no gap between them. Tubing 54 pierces through and fits tightly within metal valve housing 86. An o-ring seal 88 keeps the spray bottle 36 sealed with respect to metal valve housing 86 such that there is no leakage of the fluid from the bottle takes place. In addition, spring 74 biases plastic valve housing 78 and rubber ring 76 against cup 72 and tubing 54 which also helps to prevent leakage.

In the resting state as shown in FIG. 8A, the spray bottle 36 is filled with fluid under pressure. Spring 74 biases the upper part of the plastic valve housing 78 against cup 72 such that the bottom of the cup pushes rubber ring 76 to seal the lower end of the housing onto the lower part of metal housing 86. The rubber ring 76 is also sealed tightly around tubing 54, and the valve hole 70 remains below the rubber ring. Once the dispensing cycle begins, the magnetic frame 46 presses down on the spray bottle 36 causing the bottle to move downward such that metal housing 86 also moves downward along tubing 54 as shown in FIG. 8B. The plastic valve housing 78 in turn also moved down together with rubber ring 76. The tubing 54 which is fitted tightly within the upper cylindrical portion of the spray nozzle 40 remains fixed in place. Therefore, tubing 54 is depressed by spring 74 and is fixed to the nozzle 40. The rubber ring 76 also moves downward the same amount as the bottle 36. The thickness of the ring 76 and the diameter of the valve hole 70 are selected so that the downward movement of the spray bottle 36 causes the ring 76 to be beneath the valve hole allowing the pressurized fluid in the bottle to flow through the valve hole into tubing 54 and subsequently out through spray nozzle 40 in atomized form as indicated by arrows 66. When the dispensing cycle is over, the spring 74 returns to its resting position and pushes the spray bottle 36 upward which results in the rubber ring 76 moving upward and returning to its resting position above the valve hole 70 as shown in FIG. 8A. Fluid thus stops flowing through valve hole 70 and one dispensing cycle is thereby complete.

The preferred distance of downward travel of the bottle 36 is about three millimeters, which corresponds to the gap between the top part of frame 46 and the top part of electromagnet 50 as shown in FIG. 2. The preferred thickness of ring 76 is about 1.5 millimeters, and the diameter of the valve hole 70 is preferably about 0.25 millimeter.

Referring to FIG. 10, in the preferred embodiment of the invention, the dispenser 20 is equipped with integrated circuits (IC's) to control the dispensing operation. Two power sources input into two converters 24 and 26, which are electrical devices that convert alternating current (AC) to direct current (DC). The converters 24 and 26 are each preferably composed mainly of a transformer and a rectifier. Since most IC's are designed to be used with 12 V DC, converter 24 is a step-down converter that converts an incoming 220 V AC to 12 V DC, and continuously powers the infrared sensor 60, control circuit 28, solid state relay 32 (which is a type of electronic switch) and counter circuit 30. Control circuit 28 is composed of a number of IC's including a timing unit, which is shown by reference numeral 29 in FIG. 10 and preferably comprises a conventional type of timing unit. The function of control circuit 28 is to control the dispensing process. The solid state relay 32 is a type of electronic switch.

For ease of explanation a user's hands H are used to describe the operation of the dispenser 20. However, it will be understood that any part of a user's body, such as his arms or legs, or any implement placed such that the sensor 60 detects its presence can have the liquid dispensed upon it.

In operation, when hands H are positioned under the dispenser 20 as shown in FIG. 9, the sensor 60 detects the presence thereof and actuates control circuit 28 by a signal, pulse or like method. Control circuit 28 turns on solid state relay 32; that is, the switch is closed. The timing unit 29 in control circuit 28 determines the length of time that the switch remains closed. When solid state relay 32 is turned on, that is, the switch is closed, converter 26 is connected to an incoming 220 V AC line. Converter 26 is also a step-down converter and converts the incoming 220 V AC to 24 V DC. The 24 V DC electrical current from converter 26 energizes the electromagnet 50 which magnetically draws the magnetic frame 46 downward. The electromagnet 50 was found to operate optimally with 24 V DC supplied to it for drawing the frame 46 downward. The frame 46 when drawn down in turn presses down on spray bottle 36, and valve 55 in tubing 54 within the bottle is thereby opened. With the valve 55 opened, the fluid disinfectant is forced out of the dispenser 20 through spray nozzle 40 and through opening 42. The volume of disinfectant dispensed can be made a function of the length of time the magnetic frame 46 is depressed. Since the electromagnet 50 continues to press the frame 46 down until the solid state relay 32 is turned off, i.e., the switch opened, the length of time the relay 32 remains "on" is determined by the delay of the timing unit 29 in the control circuit 28.

The time delay of the timing unit 29 in control circuit 28 can be adjusted to provide the optimal amount of disinfectant dispensed in each dispensing cycle. Once the relay 32 is turned off, the switch is opened and the circuit is ready to proceed through the entire dispensing cycle again when the sensor 60 is again tripped. Thus, there is only a negligible waiting period between dispensing cycles. An important feature of the present invention is that if additional disinfectant is to be dispensed, the sensor 60 must be actuated again. One dispensing cycle only dispenses a predetermined volume or dose of disinfectant during a predetermined length of time. Only after the hands H have been moved out of the detection zone of the sensor 60 and then repositioned into that zone does the cycle start over. In this way, disinfectant is not wasted since only one dose is dispensed each cycle.

Once the disinfectant has been dispensed, rubbing the hands H together effectively disinfects the entire surface of the hands including the palms and backs thereof. The hands H once disinfected do not encounter the possibility of being reinfected or contaminated since there is no need to touch the dispenser 20. Use of a hand drier is also unnecessary since the dispensed fluid is volatile, and thus evaporates quickly.

An additional aspect of the circuit shown in FIG. 10 is a warning feature to notify an attendant that the spray bottle 36 is empty, or nearly so. As described above, since the volume of disinfectant dispensed is fixed per dispensing cycle, and since spray bottles 36 used with the present invention hold the same amount of fluid and the same amount of pressurized gas, the number of dispensing cycles required to empty a bottle can be experimentally determined. This number is set in the counter circuit 30 of the circuit shown in FIG. 10. Each dispensing cycle dispenses one measured dose of disinfectant. For ease of explanation, the number of doses in a bottle 36 will be assumed to be 1200, and the counter circuit 30 will be preset to that number. Referring to FIG. 10, the counter circuit 30 is connected in series to control circuit 28, so that each time control circuit 28 actuates relay 32, it also actuates the counter circuit. Each time the counter circuit 30 is actuated, it counts down one unit. Counter circuit 30 includes an alarm device which is shown by reference numeral 31 in FIG. 10 and may comprise a buzzer or a light, which is actuated when the "count" reaches zero. The alarm device 31 preferably emits a warning signal to notify an attendant that the bottle 36 is empty. The counter circuit 30 can alternatively be preset so that the alarm device 31 is actuated before the bottle 36 is completely empty. This would be done by setting the "count" in counter circuit 30 at a number less than the number of doses or dispensing cycles contained in a bottle 36. For example, if the bottle 36 contains 1200 doses, the counter circuit 30 could be set at 1190, thus causing the alarm device 31 to actuate before the bottle is completely empty. When a new bottle is placed in the dispenser 20, the counter circuit 30 must be reset manually to the maximum number, in this case either 1200 or a smaller number. In general, most counter circuits of this type presently available are of the countdown type and start the buzzer when counting reaches zero. Generally any counter circuit, either a conventional or a modified one that can count down, accordingly can be used. The counter circuit 30 is preferably designed such that the warning sound continues until an attendant installs a full spray bottle 36 in chamber 22 and resets the counter circuit to the starting number thereof.

Liquid delivered by the present dispenser 20 is atomized and spread over the hands H in as broad an area as possible in what may be called a spray zone. Preferably the hands H are about twenty centimeters away from the spray nozzle 40. The size of the spray zone can be varied by adjusting the proximity sensor 60 as described below.

The proximity sensor 60 may be any of a variety of known sensor mechanisms. One embodiment of sensor 60 includes a light emitting source, such as an LED, and a light sensor or receiver, such as a phototransistor, placed near each other in a plane and generally directed to a common region, or detection zone. The light source emits light into the zone and any object that enters the zone reflects the light back to the light sensor. The sensor mechanism would be programmed so that when the light sensor detects the reflected light, it actuates the control circuit. When no object reflects light back to the sensor, the light emitted simply dissipates into the background. It will be clear to one skilled in the art that the size of the zone will be a function of the distance between the sensor and source, the intensity of light from the source and the angle of incidence of the emitted light. To make the zone larger, the distance between the sensor and source is increased and the angle of incidence of the emitted light made more horizontal, A higher intensity light source would also tend to make the zone larger. In contrast, to make the zone smaller, the distance between the sensor and the source would be decreased and the angle of incidence would be made more vertical. A lower intensity light source would tend to make the zone smaller. The detection zone is associated with the dispensing nozzle 40 and may be said to define a dispensing zone which generally corresponds to the detection zone.

Another embodiment of sensor 60 positions the light source and light sensor so that the light emitted is always received by the sensor or receiver. In this configuration, the light emitted forms a beam which when broken by the insertion of a hand or other object into the detection zone, also interrupts the light sensor's reception of the light. When the light sensor no longer detects light, it actuates the control circuit to start operation of the dispensing apparatus, Yet another embodiment of sensor 60 includes a pair of light receiving members or sensors, such as photocells, located near each other in a plane. The sensors should be of approximately equal resistance and may be connected in a circuit such that one acts as a reference sensor and the other acts as a trigger sensor, for example, by connecting them in series with a reference junction between them. In operation, when no object is in the detection zone, both of the sensors receive substantially equal amounts of ambient light and the voltage in the reference junction remains unchanged. However, when one of the sensors (the trigger sensor) is occluded by a hand or other object in the detection zone, the difference between the light detected by the reference sensor and that detected by the trigger sensor changes the resistance of one sensor relative to the other. Thus, the voltage at the reference junction will change, and this change in voltage can be used to actuate the control circuit to start the dispensing operation.

An important aspect of the invention is that the dispensed fluid does not contact the dispenser 20. Thus, the device rarely needs to be cleaned. Furthermore, for this reason, contamination of the dispenser 20 is unlikely, which in turn increases the effectiveness of disinfection of the user's hands H. Moreover, the present dispenser 20 dispenses fluids quickly, such that no waiting time is needed by the next user after the previous user finishes. Accordingly, the dispenser 20 may dependably service a large number of users in hospitals, clinics, public washrooms, commercial kitchens, or wherever else it is convenient to install it.

From the foregoing detailed description, it will be evident that there are a number of changes, adaptations and modifications of the present invention which come within the province of those skilled in the art. However, it is intended that all such variations not departing from the spirit of the invention be considered as within the scope thereof as limited solely by the claims appended hereto.

I claim:

1. A disinfectant dispenser, comprising:

a housing having a top, a bottom and at least one wall connecting said top and bottom together, a hole being formed in said bottom;

a spray nozzle positioned generally over said hole;

a spray bottle containing disinfectant positioned within said housing;

tubing in fluid communication with the interior of said bottle at one end thereof and extending outwardly of said bottle and engaging said spray nozzle at the other end;

a reciprocating frame positioned at another end of said bottle;

biasing means positioned within said housing between said one end of said bottle and said housing bottom for maintaining said bottle in contact with said reciprocating frame; and pushing means for pushing said frame and said bottle downward relative to said housing, thereby pressing said tubing against said nozzle where both are stationary relative to said housing and thereby causing a vale at the interior end of said tubing to open such that the disinfectant in said bottle is dispensed out through said spray nozzle.

2. The dispenser of claim 1, wherein the disinfectant is a volatile liquid.

3. The dispenser of claim 2, wherein said reciprocating frame is made of a magnetic material.

4. The dispenser of claim 3, wherein said pushing means comprises an electromagnet.

5. The dispenser of claim 4, wherein said pushing means comprises an infrared sensor, a control circuit, and a solid state relay; said infrared sensor sensing the proximity of a user's hands to said hole and activating said control circuit which further actuates said solid state relay to allow electrical current to energize said electromagnet which causes said frame to push down on said bottle to dispense therefrom the volatile liquid in atomized form.

6. The dispenser of claim 5, further comprising a counter circuit which includes a buzzer and determining means for determining when said bottle is empty, and wherein when said bottle is empty as determined by said determining mean, said buzzer is actuated to signal the empty condition of said bottle.

7. The dispenser of claim 1, wherein said frame is guided by rods which pass through corresponding holes in said frame.

8. The dispenser of claim 1, wherein said frame includes a cap which holds and maintains said bottle in a vertical position relative to said housing.

9. The dispenser of claim 1, wherein said spray nozzle has two coaxial holes of different diameters, one of said holes having a diameter that corresponds to an outside diameter of said tubing and the other of said holes having a diameter that corresponds to an inside diameter of said tubing.

10. The dispenser of claim 1, wherein said tubing includes external threads on one end thereof, wherein an upper portion of said spray nozzle includes internal threads, and wherein said external threads of said tubing mate with said internal threads of said upper portion of said spray nozzle to provide a tight fit therebetween, and wherein said tubing extends outwardly of said bottle and the other end of said tubing is in communication with the disinfectant in said bottle.

11. The dispenser of claim 1, wherein said tubing has a screw-type end which engages said spray nozzle.

12. The dispenser of claim 1, wherein said tubing comprises a piece of rigid tubing.

13. The dispenser of claim 1, wherein said spray nozzle is stationary relative to said housing as said pushing means pushes said frame and said bottle to dispense the disinfectant.

14. The dispenser of claim 1, wherein said pushing means pushes said frame and said bottle downward relative to said housing.

15. The dispenser of claim 1, wherein said bottle is disposed upside down in said housing, and said spray nozzle includes a conical outlet cooperatively engaged with said hole and in fluid communication with said tubing.

16. The dispenser of claim 15, further comprising a normally closed valve disposed in said tubing which allows the disinfectant to be dispensed through said conical outlet when opened.

17. The dispenser of claim 16, wherein said bottle contains the disinfectant under pressure.

18. The dispenser of claim 16, wherein said conical outlet has an upper portion with an opening and internal threads in said opening, and said tubing has an externally threaded outward end which mates tightly with said internal threads.

19. A dispenser for dispensing flowable materials, comprising;

a housing having a bottom opening;

a nozzle position generally over said bottom opening;

a container disposed in said housing and retaining a fluid under pressure, said container having a tubing in fluid communication with the interior of said container at one end thereof and extending outwardly of said container and engaging said nozzle at the other end;

a frame movably connected to and disposed generally in said housing and including engaging means for engaging said container;

biasing means for biasing said container against said frame and ensuring that a valve at the interior end of said tubing remains normally closed; and moving means for moving said frame such that a downward force is exerted on said container by said frame and pushes said container downward relative to said housing a sufficient distance to press said tubing against said nozzle where both said tubing and said nozzle are stationary relative to said housing such that the downward movement of said container relative to said tubing causes said valve to open and thereby the fluid is dispensed out through said nozzle and said bottom opening.

20. The dispenser of claim 19, further comprising a pin affixed to said housing adjacent said frame and slidably received in a corresponding hole in said frame such that movement of said frame is thereby guided.

21. The dispenser of claim 19, wherein said engaging means includes an integral cap disposed on said frame.

22. The dispenser of claim 19, wherein said biasing means is a spring surrounding said nozzle adjacent said bottom opening.

23. The dispenser of claim 19, wherein said container comprises an inverted bottle, said nozzle includes a conical outlet cooperatively engaged to said bottom opening, said bottle includes a rigid tube providing fluid communication between the interior of said bottle and said outlet, and said valve comprises a normally closed valve disposed in said tube and which allows the fluid to be dispensed out through said outlet when said normally closed valve is opened.

24. The dispenser of claim 23, wherein said tube has an externally threaded end which mates tightly with internal threads of an opening in an upper portion of said conical outlet.

25. The dispenser of claim 19, further comprising a proximity sensor which detects the presence of an object on which the fluid is to be dispensed, said sensor being operatively coupled to said moving means and defining a detection zone wherein detection Of an object therein by said sensor actuates said moving 26. The dispenser of claim 25, wherein said frame is magnetic, and said moving means comprises:

an electromagnet disposed in said housing proximate to said frame;

a control circuit coupled to said sensor such that said sensor actuates said control circuit upon detection of the object by said sensor; and a relay, which is normally "off", connected in series with said control circuit such that said control circuit actuates said relay to an "on" condition and said relay remains "on" for a predetermined length of time, said relay being connected to said electromagnet so that when said relay is "on" said electromagnet is energized to draw said frame downward such that a downward force is exerted on said container by said frame to push said container a sufficiently distance to cause said valve to open and dispense the fluid through said nozzle and said bottom opening, and when said predetermined length of time lapses said relay is "off" and operatively disconnected from said electromagnet;

wherein said container contains a known volume of the fluid and the predetermined length of time corresponds to a measured dose of the fluid dispensed in a dispensing cycle.

27. The dispenser of claim 26, further comprising warning means for indicating when said container is empty.

28. The dispenser of claim 27, wherein said warning means comprises a counter circuit connected in series with said control circuit such that each time said control circuit actuates said relay, said counter circuit is simultaneously actuated, and wherein said counter circuit is preset to a "count" value equal to the number of measured doses of the fluid in said container such that each actuation of said counter circuit results in the "count" value decreasing by one count value wherein when the "count" value is equal to zero said counter circuit actuates a warning device to signal that said container is empty and said dispenser is thereby in need of servicing.

29. The dispenser of claim 26, further comprising warning means for indicating when said container is nearly empty, said warning means comprises a counter circuit connected in series to said control circuit such that each time said control circuit actuates said relay, said counter circuit is simultaneously actuated, and wherein said counter circuit is preset to a "count" value less than the number of measured .doses of the fluid in said container such that each actuation of said counter circuit results in the "count" value decreasing by one count value wherein when the "count" value is equal to zero said counter circuit actuates a warning device to signal that said container is nearly empty and said dispenser is thereby in need of servicing.

30. A fluid dispensing method, comprising the steps of:

providing a container containing a fluid and having a tubing in fluid communication with the interior of said container at one end thereof and extending outwardly of said container and engaging a stationary nozzle at the other end;

sensing the presence of an object in a dispensing zone associated with said nozzle;

in response to said sensing step, energizing an electromagnet and thereby generating a magnetic force which draws a frame against the container; and pushing said container downward relative to said stationary nozzle thereby pressing said tubing against said nozzle such that the relative downward movement of said container to said tubing causes a valve at the interior end of said tubing to open and thereby the fluid is dispensed from the container through the nozzle and onto the object in the dispensing zone.

31. The method of claim 30, wherein each said sensing step results in a single occurrence of said energizing step such that only a single dose of fluid is dispensed with each said sensing step.

32. A spray dispenser for spraying flowable materials from a container, comprising:

a dispenser housing including positioning means for positioning therein a container holding therein flowable material under pressure and having a spray nozzle;

a tubing in fluid communication with the interior of said container at one end thereof and extending outwardly of said container and engaging said spray nozzle at the other end;

proximity sensing means for sensing the presence of an object in a detection zone, corresponding to a dispensing zone of the flowable material out the nozzle with the container positioned in said dispenser housing, and generating a signal in response thereto;

an actuating member; and an electromagnet operated by a circuit actuated by the signal from said sensing means, said electromagnet when energized causing relative downward movement of said actuating member thereby pushing said container downward relative to said spray nozzle which is stationary relative to said housing and thereby pressing said tubing against said nozzle such that the relative downward movement of said container to said tubing causes a valve at the interior end of said tubing to open, allowing the flowable materials under pressure to be sprayed out through the nozzle onto the object in the detection zone.

33. The dispenser of claim 32, wherein said actuating member comprises a magnetic frame normally biased against the container and when said electromagnet is energized said frame is drawn downward by said energized electromagnet so as to exert pressure on the container to open the normally closed valve, thereby dispensing the flowable materials out through the nozzle.

34. The dispenser of claim 32, wherein said sensing means comprises an infrared light sensor.

35. The dispenser of claim 32, wherein said electromagnet is affixed in said housing proximate to said positioning means.

36. A dispenser for dispensing flowable materials from a container, comprising:

a dispenser housing including positioning means for positioning therein a container holding flowable material and having a nozzle;

a tubing in fluid communication with the interior of said container at one end thereof and extending outwardly of said container and engaging said spray nozzle at the other end;

proximity sensing means for sensing the presence of an object in a detection zone, corresponding to a dispensing zone of the flowable material out the nozzle with the container positioned in said dispenser housing, and generating a signal in response thereto;

an actuating member; and an electromagnet operated by a circuit actuated by the signal from said sensing means, said electromagnet when energized causing relative downward movement of said actuating member and said container;

wherein said actuating member comprises a magnetic frame normally biased against the container, and when said electromagnet is energized, said frame is drawn downward by said energized electromagnet so as to exert pressure on the container, thereby pushing said container downward relative to said spray nozzle which is stationary relative to said housing and thereby pressing said tubing against said nozzle such that the relative downward movement of said container to said tubing causes a valve at the interior end of said tubing to open, and thereby the flowable material is dispensed out through the nozzle onto the object in the detection zone.

37. A sprayable material dispenser, comprising:

a support assembly;

a container containing pressurized sprayable material and supported by said support assembly in an upside-down orientation;

a nozzle having a conical opening, a cylindrical opening in a nozzle upper portion and internal threads in said cylindrical opening;

tubing having an externally threaded end which mates tightly through several complete turns with said internal threads and is thereby secured to said nozzle and in fluid communication with said conical opening, said tubing having opening spaced from said threaded end; and valve means for selectively blocking fluid communication of said tubing opening with the interior of said container in a valve normally closed position and for communicating said tubing opening with the interior of said container in an alternative valve opened position wherein the material from said container is sprayed out through said conical opening; and sensing means for sensing the presence of an object in a dispensing zone of said nozzle and, when the object is sensed, for thereby actuating a pushing means that causes downward movement of said container relative to said stationary nozzle thereby pressing said tubing against said nozzle such that the relative downward movement of said container to said tubing causes said valve means to open and thereby the fluid is dispensed from the container through the nozzle and onto the object in the dispensing zone.

38. The dispenser of claim 37, wherein said conical opening is downwardly disposed to spray the material from said container vertically downward.

39. The dispenser of claim 37, wherein the sprayable material is a volatile disinfectant.

* * * * *